US006004058A

United States Patent [19]

Nicoll

[11] Patent Number: 6,004,058

[45] Date of Patent: Dec. 21, 1999

[54] MARKING INSTRUMENT

[75] Inventor: Roy Nicoll, Wokingham, United Kingdom

[73] Assignee: The Gillette Company, Boston, Mass.

[21] Appl. No.: 08/945,893

[22] PCT Filed: Jun. 27, 1996

[86] PCT No.: PCT/US96/10993

§ 371 Date: Jan. 28, 1998

§ 102(e) Date: Jan. 28, 1998

[87] PCT Pub. No.: WO97/02148

PCT Pub. Date: Jan. 23, 1997

[30] Foreign Application Priority Data

Jun. 30, 1995 [GB] United Kingdom ..... 9513391

[51] Int. Cl.[6] ..... B43K 5/18

[52] U.S. Cl. ..... 401/206; 401/148; 401/273

[58] Field of Search ..... 401/148, 206, 401/264, 273

[56] References Cited

U.S. PATENT DOCUMENTS

| | | | |
|---|---|---|---|
| 2,874,679 | 2/1959 | Zeelouvitech | 401/148 |
| 3,589,824 | 6/1971 | Andrews et al. | 401/273 X |
| 4,364,684 | 12/1982 | Kohno et al. | 401/273 X |
| 5,332,326 | 7/1994 | Hori | 401/206 X |

FOREIGN PATENT DOCUMENTS

| | | | |
|---|---|---|---|
| 0556440 | 8/1993 | European Pat. Off. . | |
| 926054 | 4/1955 | Germany | 401/264 |
| 9305966 | 4/1993 | WIPO . | |
| 9614998 | 5/1996 | WIPO . | |

*Primary Examiner*—Steven A. Bratlie
*Attorney, Agent, or Firm*—David A. Howley

[57] ABSTRACT

A marking instrument, especially a reservoir pen, has a diaphragm which is deflected by retraction of a marking tip to open a port to connect a feed channel to the reservoir containing a marking fluid. A cavity communicating with the port has a volume which reduces when the diaphragm deflects to open the valve and increases when the diaphragm moves to close the valve. The diaphragm has an integral forwardly extending skirt which seals against the feed member at the forward end of the skirt. These features are effective in preventing marking liquid flowing to the tip when not required and leakage of marking fluid between the diaphragm and feed member.

16 Claims, 4 Drawing Sheets

MARKING INSTRUMENT

FIELD OF THE INVENTION

This invention is concerned with marking instruments of a kind in which a supply of marking fluid is stored in a reservoir and is delivered to a marking tip under control of a valve device arranged so that the reservoir is isolated when the instrument is not in use, e.g., so that leakage and/or dry out problems do not arise. The invention relates especially, but not necessarily exclusively, to writing instruments and is applicable to highlighter pens, felt tip pens, fibre tip pens, ball-point pens, roller ball pens and to pens of other types.

BACKGROUND OF THE INVENTION

In WO 93/05966 there is described a marking instrument having a valve device comprising a diaphragm with a central hole through which extends a feed member having a feed channel for conducting marking fluid to the marking tip. The inner end of the feed channel opens through radially directed ports which are normally closed by being covered by the inner peripheral surface of the diaphragm. For opening the valve, the feed member is adapted to retract under normal writing forces experienced due to the marking tip being applied against a surface, this retraction causing the diaphragm to deflect so that it lifts clear of the ports and thereby opens up communication between the feed channel and a reservoir chamber defined rearwardly of the valve. To ensure deflection of the diaphragm, its inner edge sits against a shoulder formed on the feed member. When the force against the marking tip is removed, due to the tip being lifted from the surface, the feed member is pushed forwardly by the diaphragm which closes the ports so that the reservoir chamber is once again isolated from the feed channel. It has been found that with some types of marking fluid, when the marking tip is lifted clear from a surface against which it has been pressed, marking fluid can continue to flow or ooze to the tip despite the diaphragm valve appearing to function correctly. Although the amount of fluid is small, the collection of excess fluid at the marking tip can detract from the performance of the marking instrument and is undesirable.

SUMMARY OF THE INVENTION

The present invention has the aim of providing a solution to the foregoing problem and in accordance with the invention there is provided a marking instrument comprising a feed member with a channel for conducting to a marking tip marking fluid supplied from a reservoir chamber, the channel having an inlet port at a peripheral surface of the feed member, a resilient valve member surrounding and arranged to seal against said peripheral surface for isolating the channel from the reservoir chamber, the feed member being retractable to deflect the valve member to open the port to the reservoir chamber, and a cavity defined between the valve member and the feed member to communicate with the port, deflection of the valve member in the opening direction causing the volume of the cavity to diminish and deflection in the other direction causing an increase in the cavity volume.

With the prior art diaphragm valve, when the diaphragm is deflected to open the valve a space can open between the diaphragm and the shoulder of the feed member and fill with marking fluid. The diaphragm moves to fill this space again when the feed member moves forwardly allowing the valve to close, and the marking fluid becomes displaced from this space and into the feed channel after the valve has closed. This is the cause of the oozing problem. By providing a cavity in accordance with the invention the tendency for marking fluid to be displaced into the feed channel after the valve has closed is eliminated and the problem is averted.

The cavity can be formed by a recess, e.g. a circumferential groove, in the peripheral surface of the feed member preferably located adjacent a shoulder provided on the feed member for abutment with the valve member. Alternatively, the cavity can be formed by shaping the valve member, such as by providing a valve diaphragm with a tapered surface for co-operation with the peripheral surface of the feed member. According to another alternative the cavity is constituted by a portion of the port, the port being dimensioned so that an element of the valved member moves into the port portion when the valve is opened and moves out again when the valve is closed.

When marking fluid can occupy a space adjacent a forward edge of a diaphragm, there is a risk that the fluid can leak through and reach the exterior of the feed member in front of the engagement between the diaphragm and the feed member. Such leakage is undesirable as it may lead to malfunction or result in marking fluid leaking from the instrument.

In accordance with a second aspect, the present invention seeks to avoid the leakage problem and provides a writing instrument comprising a feed member with a channel for conducting to a marking tip marking fluid supplied from a reservoir chamber, the channel having an inlet port at a peripheral surface of the feed member, the exterior of the feed member being stepped to define a shoulder in front of said peripheral surface and an outer surface extending forwardly from the shoulder, and a resilient diaphragm surrounding and arranged to seal against the peripheral surface for isolating the port from the reservoir chamber, the diaphragm being arranged to seal constantly against said outer surface. Conveniently, the diaphragm has an integral skirt projecting forwardly and in sealing engagement with said outer surface of the feed member.

By providing an additional seal between the diaphragm and the feed member leakage between the diaphragm and feed member is precluded.

The diaphragm skirt may be arranged to closely surround the outer surface of the feed member, e.g. adjacent to and forwardly from the shoulder. However, a particularly effective seal is obtained if the skirt is equipped with an inner lip, such as at its free end, for sealing contact with the feed member, which can also ease manufacture.

The diaphragm can conveniently serve to confine the reservoir chamber and its outer edge can be adapted to seal between two body parts of the marking instrument. In accordance with a further development provided by the present invention, however, the marking instrument is arranged to receive a replaceable cartridge containing marking fluid, and comprises a seal element for co-operation with a forward end of the cartridge, said seal element being integral with a diaphragm which controls flow of marking fluid to a marking tip.

By forming the diaphragm and cartridge seal element as a unitary component manufacture and assembly may be simplified and be more economical. The seal element may be an elongate cylindrical sleeve into which a forward end portion of the cartridge is inserted with a push fit. To provide greater stiffness to the sleeve it can be reinforced externally. Preferably, a tubular carrier of stiffer material surrounds the sleeve and is united with the sleeve due to the seal component and carrier being formed in one piece as a two part moulding.

BRIEF DESCRIPTION OF THE DRAWINGS

The invention in its different aspects is described in greater detail below with reference to the accompanying drawings, in which.

DETAILED DESCRIPTION OF THE PREFERRED EMBODIMENT

Figure 1:
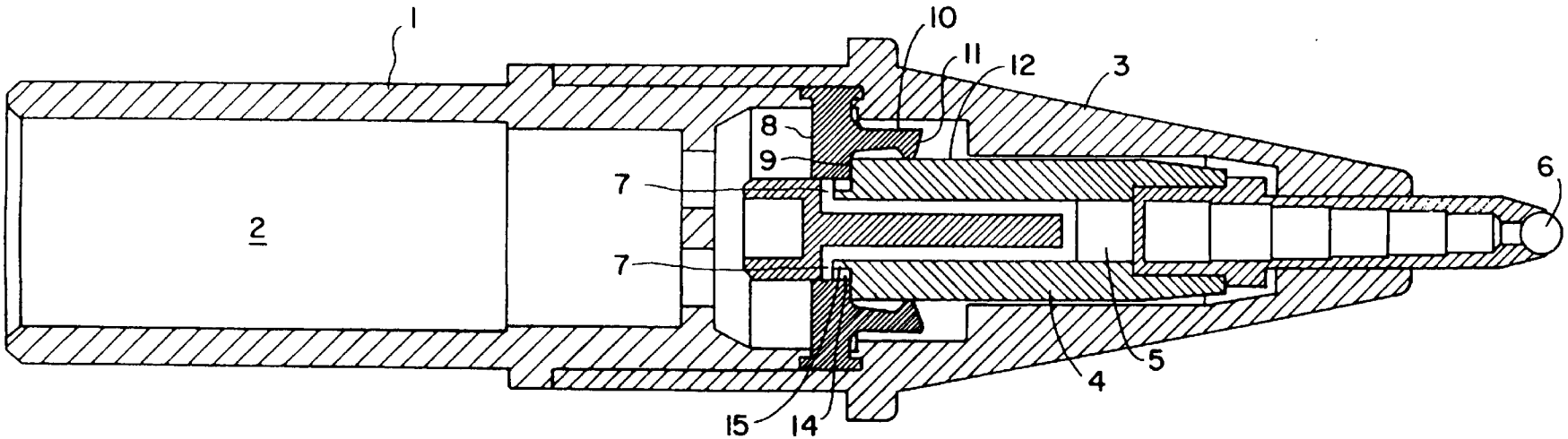
FIG. 1 is an axial cross section through the forward end of a marking instrument embodying the invention.

The marking instrument illustrated in FIG. 1 is a ball-point pen. However, it should be understood that the improvements described herein are applicable to a broad range of marking instruments including felt tip pens, fibre tip pens, roller ball pens, tubular nib pens and other writing instruments. The pen has a body including a barrel 1, only the front end portion of which is shown, enclosing a reservoir chamber 2 for storage of a volume of ink. The reservoir chamber can be of such a kind that its internal volume reduces as the ink is used up. For this purpose the rear end of the chamber can be closed by an ink follower, such as a grease plug, which moves along the chamber to follow the ink column contained in the chamber as the ink is consumed. In this way it is unnecessary to supply replacement air to the chamber to take up the space vacated by the ink as it is used. Of course other forms of reservoir chamber, such as a collapsible flaccid sack, are also possible.

The pen body includes a nose 3 with a tapering cone portion having a stepped axial bore, and a rearwardly directed cylindrical portion into which the forward end of the barrel 1 is fitted. A feed member 4 is axially slidable in the nose bore and includes a feed channel 5 for conducting ink to the ball-point tip 6. Adjacent the rear end of the feed member the feed channel opens through radially directed ports 7 at a cylindrical peripheral sealing surface of the feed member. An annular diaphragm 8 surrounds the peripheral sealing surface and is arranged to cover the ports 7 in order to close communication between the reservoir chamber and feed channel 5. The front face of the diaphragm is in abutment with a shoulder 9 provided on the feed member, and formed integrally with the diaphragm and projecting forwardly from it is a skirt 10 with an inwardly directed sealing lip 11 at this free end which seals against the outer surface 12 of the feed member at a distance in front of the shoulder. The outer edge of the diaphragm is flanged for this edge to be held securely between the barrel 1 and nose 3 and to provide a seal to prevent leakage of ink from the reservoir chamber.

Between the ports 7 and the adjacent shoulder 9 of the feed member a cavity 14 is formed by a recess 15 in the peripheral surface of the feed member, this cavity being in communication with the ports 7.

When the writing tip is pressed against a surface for writing, the feed member 4 retracts into the pen body and causes the inner part of the diaphragm to deflect rearwardly and the rear edge to lift away from the peripheral sealing surface of the feed member so that the ports 7 are opened and ink can flow from the reservoir chamber into the feed channel for delivery to the tip. During this deflection the forward inner edge of the diaphragm tends to move rearwardly away from the shoulder and inwardly into the cavity 14, thereby reducing the cavity volume. When the retraction force is removed from the tip the resilience of the diaphragm moves the feed member forwardly. During this return stroke, the rear inner edge portion of the diaphragm comes into sealing contact with the peripheral surface of the feed member behind the ports 7 so that the feed channel is disconnected from the reservoir chamber, and the forward inner edge of the diaphragm moves out of the cavity 14 creating space to accommodate any excess ink which may have found its way into any small crevices within the valve structure when it was opened or to relieve any excess pressure build up in the cavity 14. In this way any tendency for ink to continue to be displaced to the writing tip after the valve has closed is averted. The extra seal provided between the diaphragm skirt 10 and the feed member 4 limits potential for leakage between the diaphragm and the exterior surface of the feed member.

Figure 2:
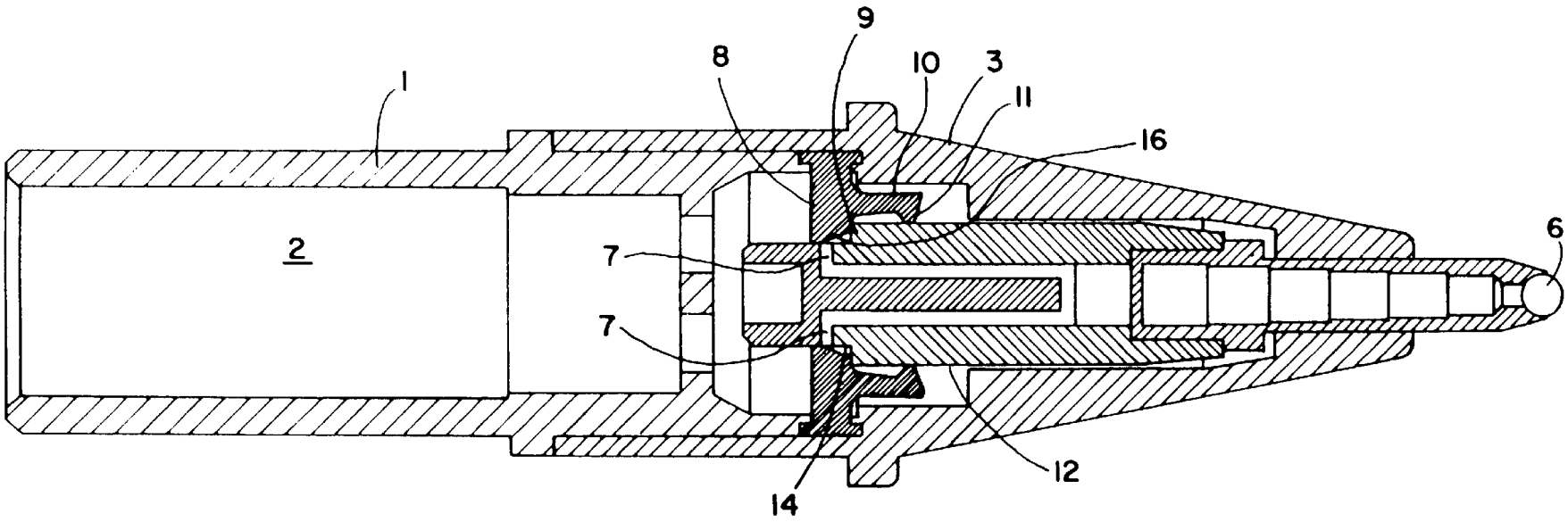
FIG. 2 is a similar view showing a second embodiment of the invention.

The pen illustrated in FIG. 2 is for the most part the same as that of FIG. 1 and the same reference numerals are used to denote corresponding parts. However, in place of a recess in the feed member the cavity 14 is defined by a tapered surface 16 on the diaphragm. The operation remains essentially the same, the diaphragm tending to reduce the volume of the cavity when the valve is opened, and tending to increase the volume again after the valve is closed during forward displacement of the feed member. Of course, the cavity could be defined by a combination of a recess in the feed member and relieving the diaphragm surface so that it is clear of the peripheral sealing surface at the forward inner edge of the diaphragm.

A similar effect to a tapered diaphragm as depicted in FIG. 2 can be obtained by a diaphragm which in the normal rest position extends outwardly, at a small angle to the radial direction, rearwardly away from the marking tip. With such an angled diaphragm, during closing of the valve the diaphragm will pass through a radial position when the valve will be closed and then as the feed member completes its forward stroke the diaphragm will move to its angled position causing the forward inner edge adjacent the shoulder to lift away from the feed member to open the cavity.

Figure 3:
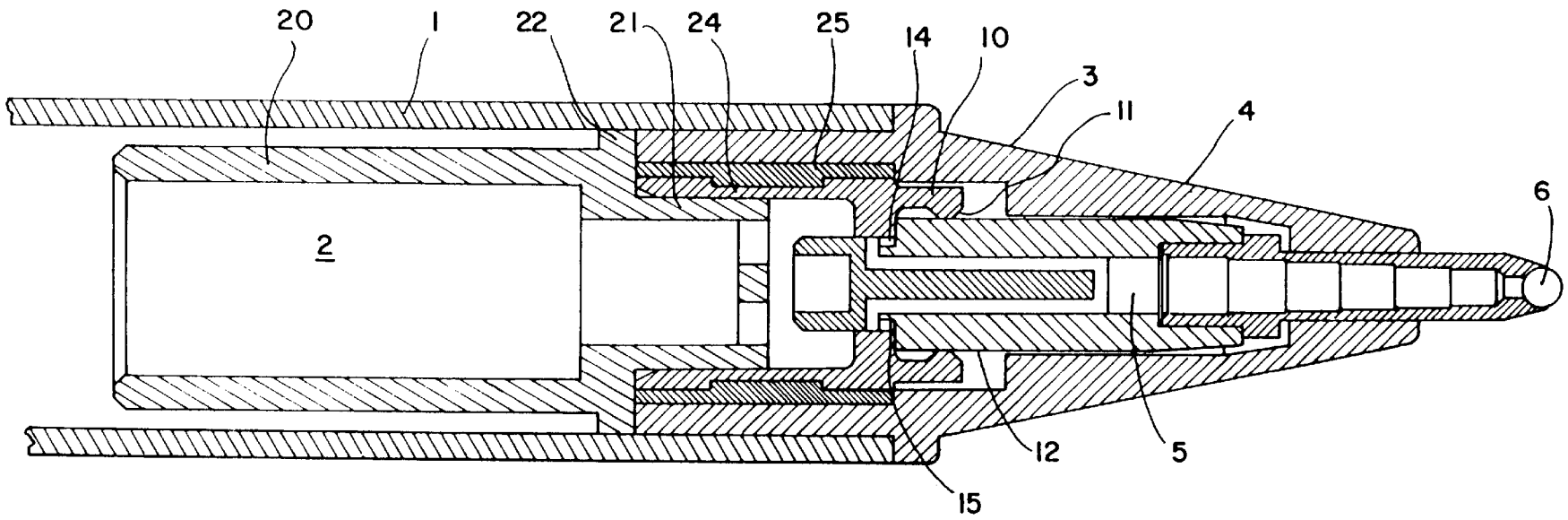
FIG. 3 is a similar view of a third embodiment.

The pen illustrated in FIG. 3 is basically similar to that of FIG. 1, but it is adapted to receive a replaceable ink cartridge 20 having at its forward end a cylindrical boss 21. The rear end face of the nose 3 defines a stop against which a flange 22 on the cartridge abuts. The diaphragm 8 has an integral rearwardly extending sleeve 24 for sealing around the boss 21 of the cartridge. To impart greater structural strength to the sealing component with a view to easing handling and assembly and to avoiding distortion in use, such as when the boss 21 is pushed into the sleeve, it is surrounded by a tubular carrier 25. Consequently the carrier and sealing component are manufactured together as a two part moulding.

Figure 5:
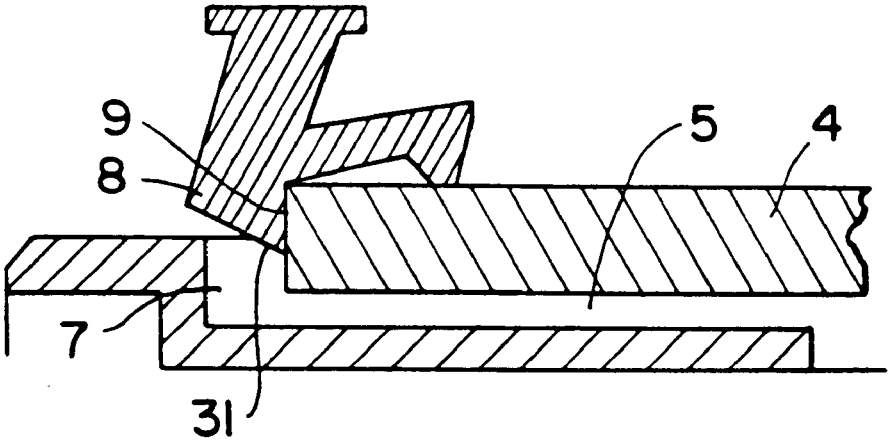
FIGS. 4 and 5 are partial views of a modified form of the valve shown in FIG. 1 and depicting the valve in closed and open conditions respectively.
Figure 4:
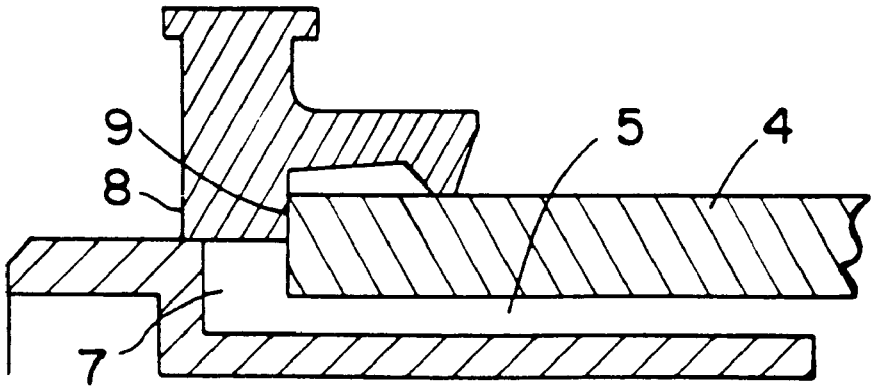

The pen valve illustrated in FIGS. 4 and 5 is substantially similar to that of FIG. 1, the main difference being that instead of an annular groove the cavity is defined by a portion of the or each port 7 located adjacent the shoulder 9 of the feed member 4. When the feed member is displaced rearwardly to open the valve, an element 31 of the diaphragm 8 enters the said portion of the port as depicted in FIG. 5, and causes an initial positive pressure to be created in the feed channel 5 before communication between the port 7 and the reservoir chamber is established. When the feed member subsequently moves forwardly again, after the rear edge of the diaphragm 8 has made contact with the feed member and interrupted the communication between the feed channel and reservoir, the element 31 of the diaphragm which entered the port moves out of the port again resulting in a negative pressure acting to draw ink back along the feed channel from the writing tip, the final valve closed condition being as illustrated in FIG. 4.

It will be understood that the positive and negative pressure effects obtained during valve opening and closing, as described in relation to FIGS. 4 and 5, will also be produced in the embodiments of FIGS. 1–3.

What is claimed is:

1. A marking instrument comprising a feed member with a channel for conducting to a marking tip marking fluid supplied from a reservoir chamber, the channel having an inlet port at a peripheral surface of the feed member, a resilient valve member surrounding and arranged to seal against said peripheral surface for isolating the channel from the reservoir chamber, the feed member being retractable to deflect the valve member to open the port to the reservoir chamber, and a cavity defined between the valve member and the feed member to communicate with the port, deflection of the valve member in the opening direction causing the volume of the cavity to diminish and deflection in the other direction causing an increase in the cavity volume.

2. A marking instrument according to claim 1, wherein the cavity is at least partly formed by a recess in the feed member adjacent the port.

3. A marking instrument according to claim 1, wherein the cavity is at least partly constituted by a portion of the port into which an element of the valve member is moved when the valve is moved to open the port.

4. A marking instrument according to claim 1, wherein the cavity is at least partly formed by the surface of the valve member confronting the peripheral surface being relieved towards a forward edge thereof.

5. A marking instrument according to claim 4, wherein said surface of the valve member is tapered.

6. A marking instrument according to claim 1, wherein the valve member is a diaphragm with a front face resting against a shoulder provided on the feed member, said cavity being located adjacent said shoulder.

7. A marking instrument according to claim 6, wherein the feed member has an outer surface extending forwardly from the shoulder, and the diaphragm has an integral forwardly extending skirt in sealing engagement with said outer surface.

8. A marking instrument according to claim 7, wherein the skirt is in sealing engagement with the feed member at the free end of the skirt.

9. A marking instrument according to claim 7, wherein the skirt is spaced outwardly from the outer surface of the feed member and has an internal lip for sealing engagement with said surface.

10. A marking instrument according to claim 6, wherein the reservoir chamber comprises a replaceable cartridge, and the diaphragm has an integral seal element arranged to seal around a forward end of the cartridge.

11. A marking instrument according to claim 10, wherein the seal element is an elongate cylindrical sleeve.

12. A marking instrument according to claim 11, wherein the sleeve is located within a reinforcing carrier.

13. A marking instrument according to claim 12, wherein the carrier and the sleeve are manufactured together as a two part moulding.

14. A marking instrument comprising a feed member with a channel for conducting to a marking tip marking fluid supplied from a reservoir chamber, the channel having an inlet port at a peripheral surface of the feed member, the exterior of the feed member being stepped to define a shoulder in front of the peripheral surface and an outer surface extending forwardly from the shoulder, and a resilient diaphragm surrounding and arranged to seal against the peripheral surface for isolating the port from the reservoir chamber, the diaphragm being arranged to seal also against said outer surface.

15. A marking instrument according to claim 14, wherein the diaphragm has an integral skirt projecting forwardly and in sealing engagement with said outer surface of the feed member.

16. A marking instrument arranged to receive a replaceable cartridge containing marking fluid and comprising a seal element for sealing co-operation with a forward end of the cartridge, said seal element being integral with a diaphragm forming part of a valve which controls flow of marking fluid to a marking tip.

* * * * *